US010486868B2

(12) United States Patent
Spivey et al.

(10) Patent No.: US 10,486,868 B2
(45) Date of Patent: Nov. 26, 2019

(54) INSULATED DRINKING VESSEL WITH MULTIFUNCTION LID

(71) Applicant: Base Brands, LLC, Atlanta, GA (US)

(72) Inventors: Patrick Spivey, Atlanta, GA (US); Kenneth Kreafle, Atlanta, GA (US)

(73) Assignee: Basc Brands, LLC, Atlanta, GA (US)

( * ) Notice: Subject to any disclaimer, the term of this patent is extended or adjusted under 35 U.S.C. 154(b) by 0 days.

(21) Appl. No.: 15/715,587

(22) Filed: Sep. 26, 2017

(65) Prior Publication Data

US 2019/0092540 A1 Mar. 28, 2019

(51) Int. Cl.
*B65D 51/18* (2006.01)
*B65D 43/02* (2006.01)
(Continued)

(52) U.S. Cl.
CPC ..... *B65D 51/18* (2013.01); *B65D 43/0202* (2013.01); *B65D 43/165* (2013.01); *B65D 43/22* (2013.01); *B65D 47/0857* (2013.01); *B65D 81/3865* (2013.01); *B65D 2251/009* (2013.01); *B65D 2251/0021* (2013.01); *B65D 2251/0025* (2013.01); *B65D 2251/0028* (2013.01);
(Continued)

(58) Field of Classification Search
CPC .... B65D 2205/02; B65D 47/14; B65D 43/02; B65D 47/08; B65D 47/06; B65D 2251/1008; B65D 51/18
USPC ..... 220/592.09, 592.2, 254.9, 254.1, 259.2, 220/256.1, 715, 714, 345.6, 345.5, 345.4, 220/254.2, 212.5, 254.3, 831, 832, 254.4, 220/259.5, 812, 813, 811; 215/387, 235; 222/561, 559
See application file for complete search history.

(56) References Cited

U.S. PATENT DOCUMENTS 2,304,214 A 12/1942 Straub
3,059,816 A 10/1962 Goldstein
(Continued)

OTHER PUBLICATIONS

Reduce website, Hot Tumbler, Publication date unknown [site visited Feb. 19, 2019], Available on the Internet URL https://reduceseveryday.com/collections/leisure-hot/products/hot-1-tumbler-16oz.

(Continued)

*Primary Examiner* — J. Gregory Pickett
*Assistant Examiner* — Tia Cox
(74) *Attorney, Agent, or Firm* — Park, Vaughan, Fleming & Dowler LLP

(57) ABSTRACT

The present embodiments describe an insulated drinking vessel and a multifunction lid. In an embodiment, the drinking vessel can be configured to receive a multifunction lid. The multifunction lid may, in one embodiment, include a first opening having a first cover. The first cover is movably disposed on the lid in at least a first and second position, where the first opening is larger when the first cover is in its first position than when in its second position. In an embodiment, the multifunction lid may additionally include a second opening for drinking or sipping directly through the lid. In an embodiment, the lid may include a second cover for covering the second opening in a first position and for allowing access to the fluid through the second opening in a second position. In an embodiment, liquid in said container dispenses more rapidly from the second opening when the first cover is in its first position than when in its second position.

16 Claims, 6 Drawing Sheets

(51) Int. Cl.

| | |
|---|---|
| ***B65D 43/16*** | (2006.01) |
| ***B65D 43/22*** | (2006.01) |
| ***B65D 47/08*** | (2006.01) |
| ***B65D 81/38*** | (2006.01) |

(52) U.S. Cl.

CPC ..... *B65D 2251/0081* (2013.01); *B65D 2251/0087* (2013.01); *B65D 2543/00046* (2013.01)

(56) References Cited

U.S. PATENT DOCUMENTS

| | | | | |
|---|---|---|---|---|
| 3,061,151 | A | 10/1962 | Clare | |
| 4,040,549 | A | 8/1977 | Sadler | |
| 4,545,508 | A | 10/1985 | Cribb, Jr. et al. | |
| D295,831 | S | 5/1988 | Urion | |
| 5,086,941 | A * | 2/1992 | English | B65D 55/024 220/345.2 |
| 5,203,467 | A * | 4/1993 | Tucker | B65D 43/0212 220/254.3 |
| 5,244,113 | A * | 9/1993 | Stymiest | B65D 51/242 215/228 |
| 5,294,014 | A | 3/1994 | Wyatt | |
| 5,413,257 | A * | 5/1995 | Amberger | B44D 3/08 222/472 |
| 5,415,312 | A | 5/1995 | Mueller | |
| 5,462,189 | A * | 10/1995 | Pierce | B65D 47/089 220/815 |
| 5,653,124 | A | 8/1997 | Weber | |
| D386,948 | S | 12/1997 | Wissinger | |
| D398,187 | S | 9/1998 | Parker | |
| D416,755 | S | 11/1999 | Trombly | |
| 6,098,834 | A | 8/2000 | Matsumoto | |
| 6,382,476 | B1 | 5/2002 | Randall | |
| D481,591 | S | 11/2003 | Lin | |
| D485,759 | S | 1/2004 | Janky et al. | |
| 6,752,287 | B1 * | 6/2004 | Lin | A47G 19/2272 220/254.9 |
| D493,068 | S | 7/2004 | Slater | |
| 7,021,481 | B2 | 4/2006 | St. Germain | |
| D539,609 | S | 4/2007 | Ying | |
| D565,901 | S | 4/2008 | Edelstein | |
| D577,548 | S | 9/2008 | Homma | |
| D584,106 | S | 1/2009 | Wong | |
| D589,747 | S | 4/2009 | Wong | |
| D591,103 | S | 4/2009 | Wong | |
| D600,071 | S | 9/2009 | Carreno | |
| D600,073 | S | 9/2009 | Carreno | |
| D625,951 | S | 10/2010 | Baek | |
| 7,918,359 | B2 * | 4/2011 | Paris | B65D 17/506 220/254.3 |
| D643,245 | S | 8/2011 | Minarsch | |
| D688,092 | S | 8/2013 | Arnold | |
| D691,416 | S | 10/2013 | Eyal | |
| D696,940 | S | 1/2014 | Hale | |
| 8,672,174 | B1 | 3/2014 | McMullin | |
| D713,686 | S | 9/2014 | Eyal | |
| D715,100 | S | 10/2014 | Eyal | |
| D717,115 | S | 11/2014 | Lane et al. | |
| D719,023 | S | 12/2014 | Hu | |
| 8,899,440 | B2 | 12/2014 | Arnold | |
| D721,535 | S | 1/2015 | Chapman | |
| D721,540 | S | 1/2015 | Grcic | |
| D731,251 | S | 6/2015 | Lane | |
| D747,199 | S | 1/2016 | Phillips | |
| D747,649 | S | 1/2016 | Phillips | |
| D751,338 | S | 3/2016 | Seiders | |
| D751,339 | S | 3/2016 | Seiders | |
| D751,340 | S | 3/2016 | Seiders | |
| D751,341 | S | 3/2016 | Seiders | |
| 9,398,822 | B2 * | 7/2016 | Wille | B65D 43/0222 |
| D788,583 | S | 6/2017 | Tu | |
| D789,737 | S | 6/2017 | Eyal | |
| D802,362 | S | 11/2017 | Spivey et al. | |
| D803,619 | S | 11/2017 | Seiders et al. | |
| D803,684 | S | 11/2017 | Seiders et al. | |
| D804,905 | S | 12/2017 | Seiders et al. | |
| D814,240 | S | 4/2018 | Kabalin | |
| D815,893 | S | 4/2018 | Seiders et al. | |
| D819,406 | S | 6/2018 | Rivera | |
| D820,045 | S | 6/2018 | Harrington, III et al. | |
| D821,151 | S | 6/2018 | Lapsker | |
| D836,395 | S | 12/2018 | Seiders et al. | |
| 10,159,368 | B2 * | 12/2018 | Lin | A47G 19/2272 |
| D836,974 | S | 1/2019 | Seiders et al. | |
| 2003/0071041 | A1 * | 4/2003 | Vogel | B65D 21/0219 220/254.2 |
| 2003/0168455 | A1 * | 9/2003 | Zettle | B65D 47/0895 220/254.3 |
| 2005/0045634 | A1 * | 3/2005 | Ward | A47G 19/2272 220/254.3 |
| 2005/0269325 | A1 * | 12/2005 | Belcastro | A47G 23/0233 220/254.3 |
| 2006/0043091 | A1 * | 3/2006 | Pinelli | A47G 19/2272 220/254.3 |
| 2007/0164026 | A1 * | 7/2007 | Morrissey | B65D 17/506 220/254.3 |
| 2008/0073343 | A1 * | 3/2008 | Shadrach | B65D 47/286 220/212 |
| 2010/0200602 | A1 | 8/2010 | Chan | |
| 2012/0145712 | A1 * | 6/2012 | Bratsch | B65D 47/2018 220/254.2 |
| 2012/0241454 | A1 | 9/2012 | Dennis | |
| 2013/0062358 | A1 * | 3/2013 | El-Saden | A47G 19/2272 220/715 |
| 2013/0200112 | A1 * | 8/2013 | Pierre | B65D 47/0847 222/546 |
| 2013/0320012 | A1 * | 12/2013 | Lucas | B65D 17/506 220/254.1 |
| 2014/0263476 | A1 | 9/2014 | Blain et al. | |
| 2016/0270572 | A1 * | 9/2016 | Karussi | A47G 19/2272 |
| 2017/0273484 | A1 | 9/2017 | Spivey et al. | |
| 2018/0332987 | A1 | 11/2018 | Lin | |

OTHER PUBLICATIONS

Starbucks; "Starbucks Holiday 2013 Candy Twist Tumbler, 12 fl oz", downloaded at https://www.amazon.com/starbucks-holiday-candy-twist-tumbler/dp/b00gpwxc6Q, May 1, 2018.

Starbucks; "Starbucks New Logo Grande Travel Mug/Tumber", downloaded at https://www.amazon.com/starbucks-logo-Grande-Travel_Tumbler/dp/B00RAK5PQ2, May 1, 2018.

Starbucks; Starbucks Stainless Steel Tumbler with Handle—Charcoal, 16 Fl Oz, downloaded at https://www.amazon.com/Starbucks-Stainless-Steel-Tumbler_Handle/dp/B00F12IIPQ, May 1, 2018.

Starbucks; "Starbucks DOT Collection Tumbler—Graffiti Green Dot, 16 Fl Oz" downloaded at https://www.amazon.com/Starbucks-DOT-Collection-Tumbler-Graffiti/dp/B00RF0Z5EO, May 1, 2018.

Starbucks; "Starbucks New Logo Tall Travel Mug/Tumbler" downloaded at https://www.amazon.com/Starbucks-Logo-Tall-Travel-Tumbler/dp/B00O0L1ARM, May 1, 2018.

Reduce Everyday. Core Mug 12 oz. Aug. 19, 2014 [earliest online date], [site visited May 19, 2017]. Available from Internet, <URL:https://reduceeveryday.com/products/core-mug-12oz>.

* cited by examiner

INSULATED DRINKING VESSEL WITH MULTIFUNCTION LID

FIELD

This disclosure relates generally to drinking vessels, and more specifically, to an insulated drinking vessel with a multifunction lid.

BACKGROUND

Drinking vessels, such as cups, insulated beverage containers, canteens, and the like are used to contain fluids for drinking. Fluids tend to spill if left in an open container, so many drinking vessels include a lid. Some lids include openings for allowing controlled passage of the fluid to a user of the vessel. In some cases, the opening is a hole or slot for receiving a drinking straw. In other cases, the opening is a hole or slot for sipping directly through the lid. Various forms of such drinking vessels are known in the art. For example, paper disposable cups commonly include a plastic lid with an "X" shaped opening cut in the surface thereof for receiving a drinking straw. Many disposable coffee cups may be covered with a lid that includes a slot or spout for sipping directly through the lid. Such lids often include a secondary hole or opening for allowing passage of air through the lid, thereby equalizing the pressure inside the drinking vessel and the environment outside of the drinking vessel as the liquid exits the vessel. Equalizing the pressure in this manner allows the fluid to more easily and smoothly exit the vessel.

Some drinking vessels are insulated to reduce thermal transfer between the fluid contained in the drinking vessel and the external environment. For example, some disposable coffee cups are formed of an insulating material, such as a polymer foam. Other insulated drinking vessels may include an inner vessel and an outer shell, where at least a portion of the outer shell is spaced apart from a portion of the inner vessel. In some insulated drinking vessels, the space between the inner vessel and the outer shell is filled with air. In other cases the space may be filled with an insulating material, such as a fibrous material, a polymer foam material, or the like. In other cases, the space between the inner vessel and the outer shell is vacuum-sealed. Known drinking vessels are commonly made from paper, polymers, foam, plastic, metal, and the like.

People often use covered drinking vessels when they are on the move. For example, it may be desirable to cover a drinking vessel when transporting the fluid on foot or in a vehicle. Additionally, it may be desirable to use a covered drinking vessel in the outdoors to prevent contamination of the fluids by dirt, insects, or the like. It also may be desirable to cover a drinking vessel in order to further help keep its contents hot or cold, as the case may be.

It is known that by fully covering the vessel, its liquid contents are inhibited from pouring out through an established spout (or other opening) due to backpressure exerted on the liquid inside. In other words, as fluid exits a covered vessel, the vacuum created by the exiting fluid causes pressure inside the vessel to drop below the pressure outside the vessel. This pressure differential causes air outside the vessel to flow through the spout and into the interior of the vessel until the pressure inside and outside the vessel reaches equilibrium. As this is taking place, the fluid inside the vessel is inhibited from exiting the vessel as quickly and/or as smoothly as it otherwise would if the internal and external pressures were the same. As indicated above, this is one reason for including a secondary hole or opening in the cover, i.e., it reduces the internal and external pressure differential and, therefore, allows the liquid to more freely escape from the vessel through the spout.

Unfortunately, drinking vessels typically are only provided with fixed secondary holes, thereby limiting the speed at which the vessel's contents can escape the vessel's spout. Since it is in some cases desirous to have the liquid escape more slowly (i.e., when dealing with hot liquids) and in some cases to escape more rapidly (i.e., when dealing with cold liquids), it is desirous to have a lid whose secondary hole is variable at the user's option. That way, the user can adjust how rapidly the liquid is dispensed. This and other aspects of the present invention are described below in more detail.

SUMMARY

Embodiments of systems and apparatuses including an insulated drinking vessel with a multifunction lid are described. In one embodiment, an apparatus includes a lid configured to engage an opening of a container, the lid configured to at least partially retain the liquid within the container. The apparatus may further include a first opening in the lid for exposing the contents of the vessel to the atmosphere. Additionally, the apparatus may include a second opening in the lid for dispensing liquid from the vessel. The apparatus may also include a first cover for covering the first opening in one of several different positions, where the vessel's contents are exposed to different amounts of the atmosphere at each different position of the first cover. The apparatus also may include a second cover for covering the second opening in a first position and for allowing access to the second opening in a second position.

BRIEF DESCRIPTION

The following drawings form part of the present specification and are included to further demonstrate certain aspects of the present invention. The invention may be better understood by reference to one or more of these drawings in combination with the detailed description of specific embodiments presented herein.

Figure 9A:
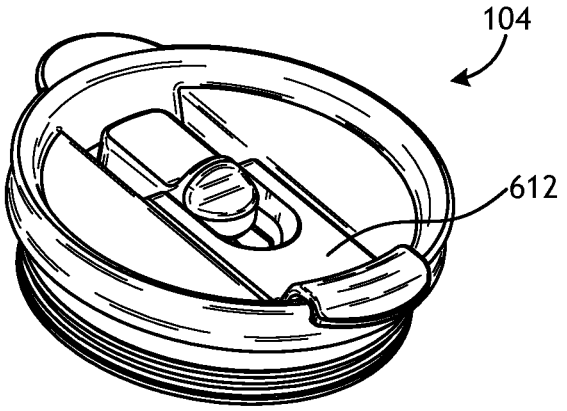

FIG. 9A a top perspective view diagram of one embodiment of a multifunction lid with a cover in a closed position.

Figure 9B:
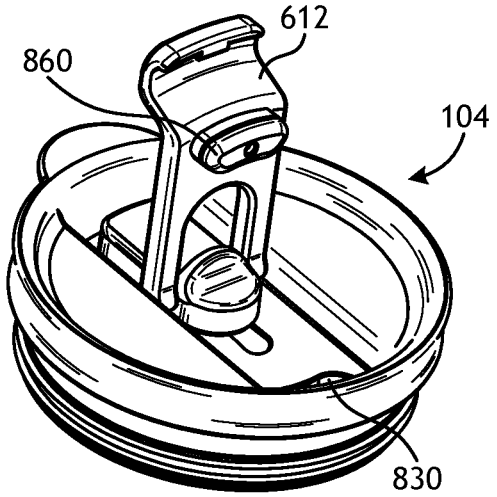

FIG. 9B is a top perspective view diagram of one embodiment of a multifunction lid with a cover in an actuated position.

Figure 9C:
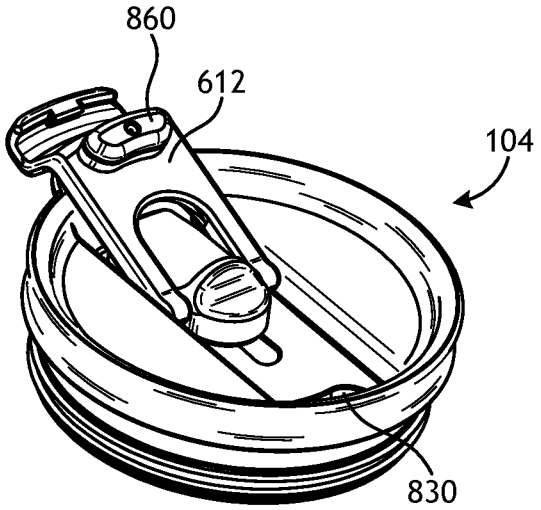

FIG. 9C is a top perspective view diagram of one embodiment of a multifunction lid with a cover in an open position.

Figure 10A:
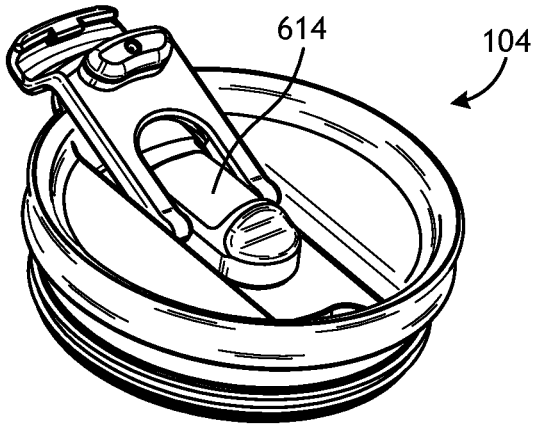

FIG. 10A a top perspective view diagram of one embodiment of a multifunction lid with a cover in a closed position.

Figure 10B:
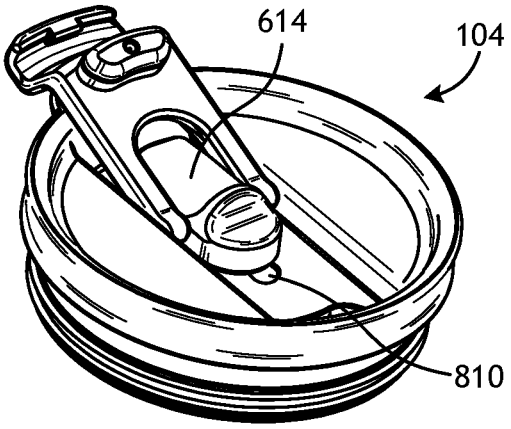

FIG. 10B is a top perspective view diagram of one embodiment of a multifunction lid with a cover in a partially open position.

Figure 10C:
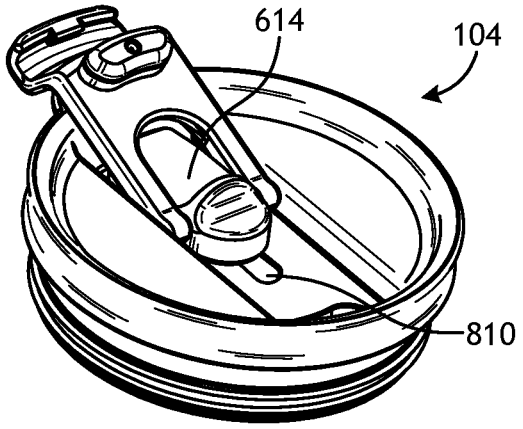

FIG. 10C is a top perspective view diagram of one embodiment of a multifunction lid with a cover in a fully open position.

DETAILED DESCRIPTION

Various features and advantageous details are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The present embodiments describe an insulated drinking vessel with a multifunction lid. For example, in an embodiment, the insulated drinking vessel may be a tumbler style cup. The tumbler may be formed of stainless steel sheet metal. The drinking vessel may include an inner vessel and an outer shell where at least a portion of the inner vessel is spaced apart from the outer shell, and wherein a space between the inner vessel and the outer shell is vacuum-sealed.

In an embodiment, the drinking vessel can be configured to receive a multifunction lid. Other embodiments include only the lid. The multifunction lid may, in one embodiment, include a first opening that exposes the interior of the vessel to the outside atmosphere. In an embodiment, the multifunction lid may additionally include a second opening for drinking or sipping directly through the lid. In an embodiment, the lid may include an operable cover for covering at least one of the openings in a first position and for allowing access to the fluid through the opening in a second position. In a further embodiment, the lid may include a plurality of operable covers. A first operable cover may be configured for covering the first opening in a first position and exposing the interior of the vessel to the outside atmosphere in a second position. The lid may also include a second operable cover for covering the second opening in a first position and allowing drinking directly through the second opening in a second position. In a further embodiment, the first operable cover may be configured for variably covering the first opening so that the size of the first opening varies depending on the position of the first cover.

In a further embodiment, the multifunction lid may include a raised edge for engaging the lip of a user when the user drinks from the vessel. The smooth surface of the raised edge may provide a superior tactile experience to the user when drinking as compared to the relatively rough surface of the metal drinking vessel. In a further embodiment, the raised edge may be formed with a contour, such as a concave contour, for more fully engaging a lower lip, thereby reducing the tendency for spillage while drinking.

Various other non-limiting embodiments are described below.

Figure 1:
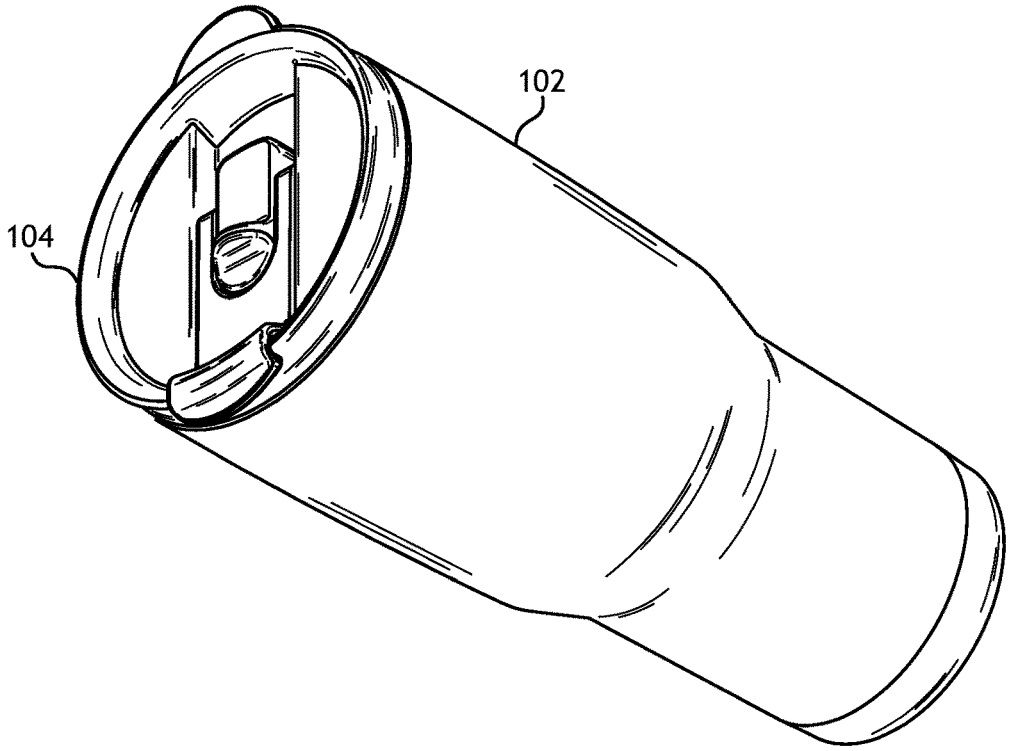
FIG. 1 is a top perspective view diagram of one embodiment of an insulated drinking vessel with a multifunction lid.

FIG. 1 is a top perspective view diagram of one embodiment of an insulated drinking vessel 102 with a multifunction lid 104. In an embodiment, the multifunction lid 104 may engage an interior surface of the vessel 102 when seated. In another embodiment, the multifunction lid 104 may engage an exterior surface of the vessel 102 when seated. Beneficially, the multifunction lid 104 may contain (or help keep) a fluid within the vessel 102. The vessel 102 may be insulated to reduce thermal conduction between a fluid contained therein and the external environment. For example, the vessel may be a stainless steel vacuum insulated tumbler. Other configurations, shapes, and sizes of the vessel also are possible.

Figure 2:
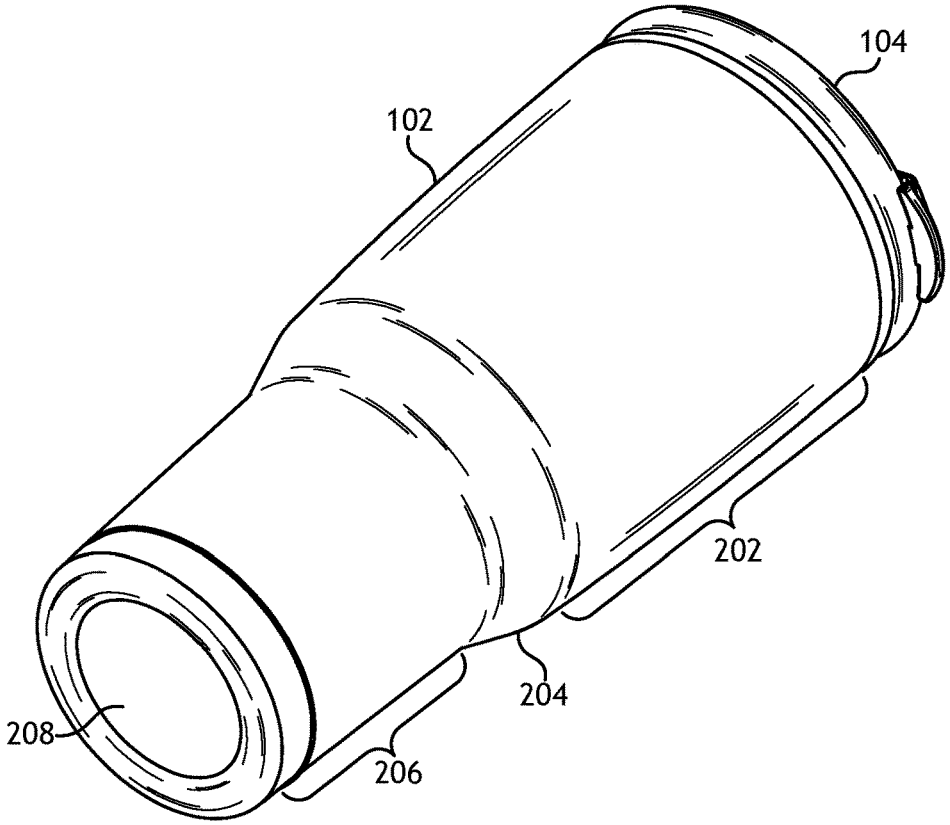
FIG. 2 is a bottom perspective view diagram of one embodiment of an insulated drinking vessel with a multifunction lid.

FIG. 2 is a bottom perspective view diagram of one embodiment of an insulated drinking vessel 102 with a multifunction lid 104. In an embodiment, the drinking vessel 102 may include a first portion 202 and a second portion 206, with a transition 204 between the first portion 202 and the second portion 206. In one embodiment, an average outer diameter of the first portion 202 may be greater than an average outer diameter of the second portion 206. More specifically, the outer diameter along the second portion 206 may be within a range that is suitable for fitting in an average cup holder of an automobile. Additionally, the drinking vessel 102 may include a bottom 208.

Figure 3:
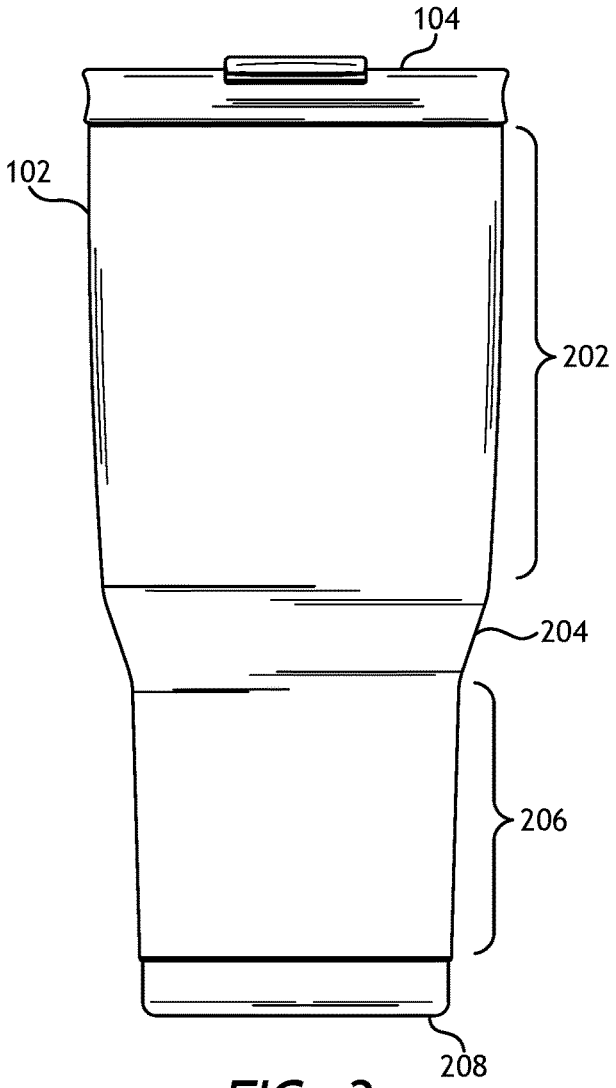
FIG. 3 is a side view diagram of one embodiment of an insulated drinking vessel with a multifunction lid.

FIG. 3 is a side view diagram of one embodiment of an insulated drinking vessel 102 with a multifunction lid 104. The embodiment further illustrates contours of the first portion 202, the second portion 206, and the transition 204. The insulated drinking vessel 102 may be manufactured from one or more sheets of stainless steel, or other metal material, where the ends of the sheet are welded together, or otherwise attached to form a generally cylindrical profile, and a bottom piece 208 is attached to a bottom edge of the cylinder for forming a vessel suitable for holding a fluid. Other configurations, materials, and/or manufacturing methods within the skill of the art are possible.

Figure 4:
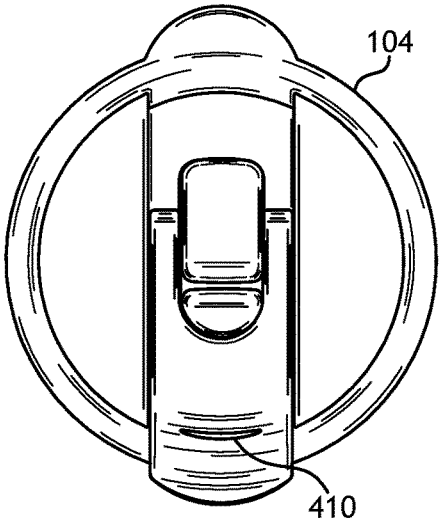
FIG. 4 is a top view diagram of one embodiment of an insulated drinking vessel with a multifunction lid.

FIG. 4 is a top view diagram of one embodiment of an insulated drinking vessel 102 with a multifunction lid 104. As shown, the outer diameter of the multifunction lid 104 may be greater than the outer diameter of the vessel 102.

Figure 5:
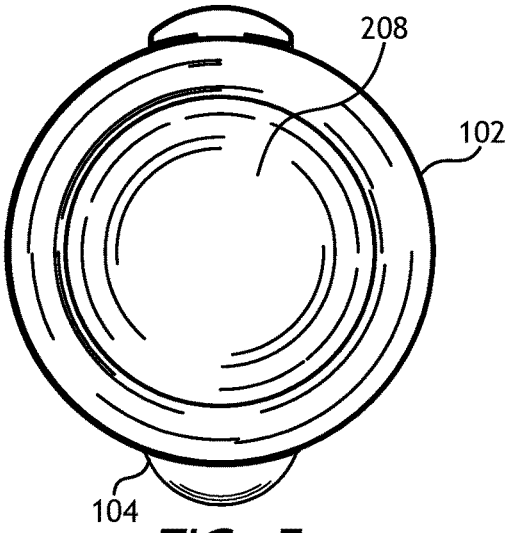
FIG. 5 is a bottom view diagram of one embodiment of an insulated drinking vessel with a multifunction lid.

FIG. 5 is a bottom view diagram of one embodiment of an insulated drinking vessel 102 with a multifunction lid 104, where the bottom comprises a bottom piece 208. In an alternative embodiment, the bottom and sides of the vessel 102 may be a single piece of material, which has been stamped, pressure formed, forged, extruded, or otherwise formed into the shape of the vessel 102, for example.

Figure 6:
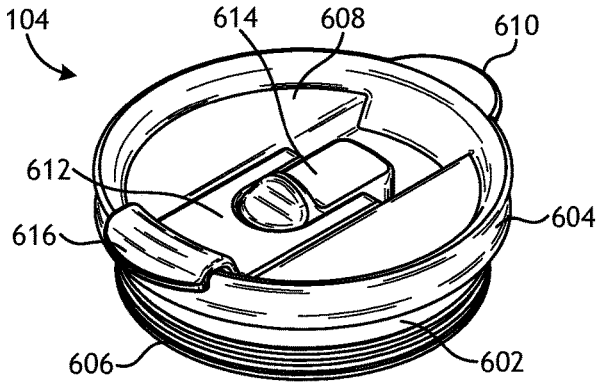
FIG. 6 is a top perspective view diagram of one embodiment of a multifunction lid.

FIG. 6 is a top perspective view diagram of one embodiment of a multifunction lid 104. In an embodiment, the lid 104 includes a body 602 for engaging at least a portion of the vessel 102 for assisting in retaining the fluid within the vessel 102. The lid 104 may also include a raised edge 604 suitable for engaging a lip of a user during use. For example, when drinking from the vessel 102 through the lid 104, the user's bottom lip may engage the raised edge 604, rather than the vessel's surface, which may be preferable in some embodiments.

The lid 104 may further include one or more sealing members 606 for creating a seal between the body 602 of the lid 104 and a portion of the vessel 102. For example, the sealing member 606 may be an annular rubber or plastic ring, in some embodiments. In particular, multiple sealing members 606 may engage a portion of the vessel 104. In one embodiment, the lid 104 includes two sealing members 606. In an embodiment, a recess 608 may be formed in the upper surface of the lid 104, the recess 608 for retaining liquid inadvertently spilled from the cup through the lid.

In an embodiment, the lid 104 may also include a tab 610 for assisting in operating the lid. For example, the tab 610 may be used for grasping the lid 104 to remove it from an opening of the vessel 102.

The lid 104 may also include a first cover 614 for variably (or otherwise) covering a first opening (not shown) in the lid 104. The first opening can be used for exposing the contents of the vessel 102 to the atmosphere. The lid 104 may also include a second cover 612 for removably covering a second opening (not shown) in the lid 104. The second opening can be used as a spout or other opening for drinking or otherwise accessing the liquid in vessel 102.

The lid 104 may also be configured so the first cover 614 fully covers the first opening when in a first position, partially covers the first opening when in a second position, and does not cover any of the first opening when in a third position. Positions of the first cover between the first and third position—either more open or more closed than the second position—also are possible such that the vessel's contents are exposed to different amounts of the atmosphere at each different position of the first cover.

The lid 104 may also be configured so the second cover 612 covers the second opening when in a first position and for allowing access to the second opening when in a second position. In a further embodiment, the second cover 612 may include a locking mechanism 616 for locking the first cover 612 into a closed or open position. In one embodiment, the locking mechanism 616 may include a flange with a lip thereon for engaging a portion of the raised edge 604 (when in a closed/first position) or a recess thereon for engaging the outer edge of tab 610 (when in a open/second position). Note, as will be described in more detail below, FIG. 9A shows the second cover 612 in a locked, closed position, whereas FIG. 9C shows the second cover 612 in a locked, open position.

Figure 7:
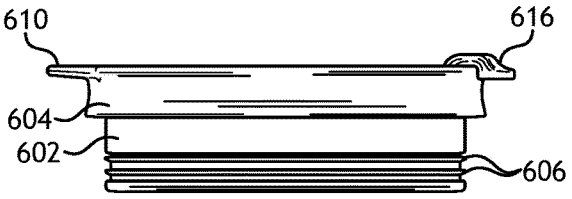
FIG. 7 is a side view diagram of one embodiment of a multifunction lid.

FIG. 7 is a side view diagram of one embodiment of a multifunction lid 104. The embodiment of FIG. 7 further illustrates the contour of the raised edge 604. For example, the raised edge 604 may be concave in shape. Also shown is tab 610, which may be formed directly on a portion of the raised edge 604. FIG. 7 also shows an embodiment of the sealing member 606, in which the sealing member includes two annular rings applied to the body 602. The sealing member 606 operates to secure lid 104 to vessel 102, while also providing a substantially airtight and liquid-tight barrier between lid 104 and vessel 102. Alternate techniques of securing lid 104 to vessel 102 are possible, including a threaded or other snap-on connection. FIG. 7 also shows locking mechanism 616 in its closed/locked position in which a lip of locking mechanism 616 snaps down around the top edge of raised edge 604.

Figure 8A:
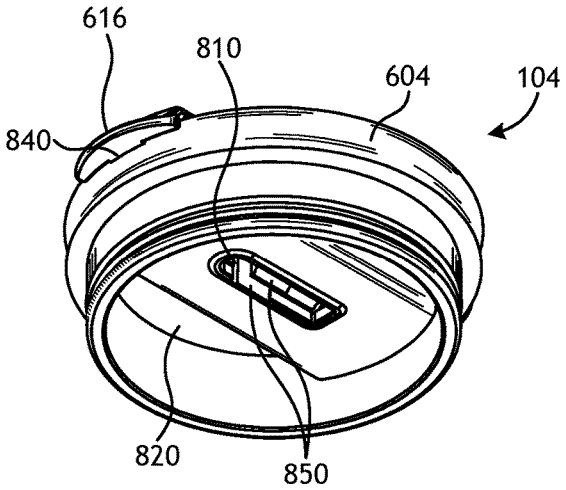
FIG. 8A is a bottom perspective view diagram of one embodiment of a multifunction lid.

FIG. 8A is a bottom perspective view diagram of one embodiment of a multifunction lid 104. In an embodiment, the lid 104 includes a concave or hollowed-out underside 820 through which first opening 810 extends. As such, in this embodiment, when first cover 614 is open, the contents of the vessel 102 are exposed to the atmosphere through first opening 810. FIG. 8A also shows an embodiment of first cover 614, namely an embodiment in which it includes two compressible securing members 850 that are shaped to compress toward one another as they are pushed (for installation) through first opening 810 and, once through, expand (or decompress) so they secure first cover 614 in place on lid 104. In this embodiment, note that while first cover 614 is "secured" into place on lid 104, first cover 614 still is able to slide back and forth (transverse to first opening 810) so that first opening 810 becomes larger or smaller (i.e., more open or more closed) as the case may be depending on which way first cover 614 is moved. For example, FIGS. 1, 4, 6, and 10A show first cover 614 fully closed, whereas FIGS. 9A-C, 10B, and 10C show first cover 614 open. FIG. 8A further illustrates an embodiment of locking mechanism 616 on second cover 612, i.e., illustrating that it locks second cover 612 in a closed position by using its conforming shape to clasp or bind itself to raised edge 604. In this particular embodiment, locking tab 840 on locking mechanism 616 extends over and then under raised edge 604 to hold second cover 612 in is closed position. In this embodiment, second cover 612 is "locked" closed such that it can be released (opened) or locked (closed) manually through a minor force exerted by a user.

Figure 8B:
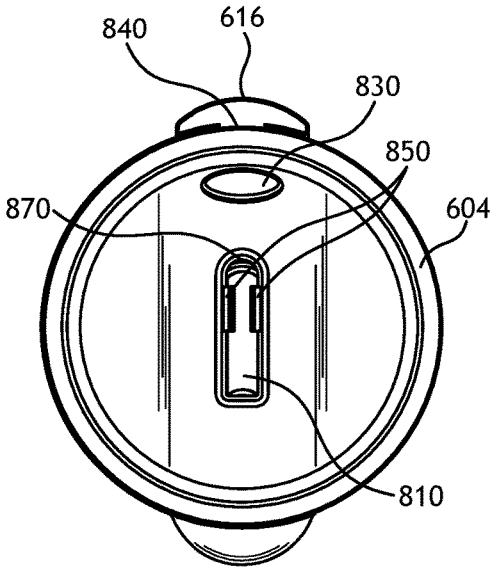
FIG. 8B is a bottom view diagram of one embodiment of a multifunction lid.

FIG. 8B is a bottom view diagram of one embodiment of a multifunction lid 104. This view better illustrates securing members 850, first opening 810, and second opening 830. It also once again illustrates locking mechanism 616 disposed on second cover 612, and locking tab 840 on locking mechanism 616. As shown, second cover 612 is in its closed/locked position (by virtue of locking tab 840 on locking mechanism 616 being in place under the lip of raised edge 604), thus sealing second opening 830. Likewise, first cover 614 is in a nearly closed position (by virtue of securing members 850 being positioned near one end of first opening 810), thus providing the very small opening to the atmosphere at 870.

Figure 8C:
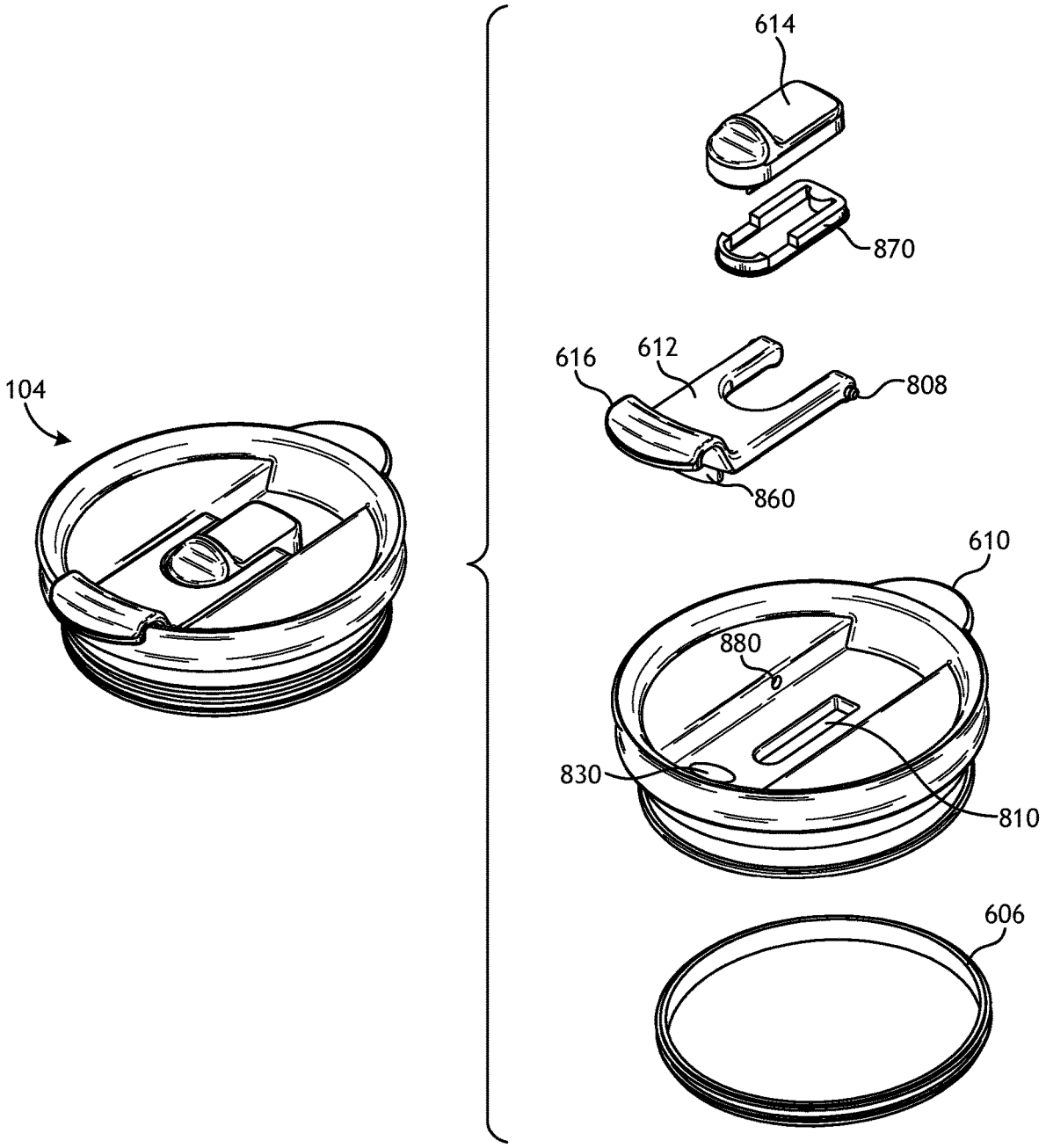
FIG. 8C is an exploded view diagram of one embodiment of a multifunction lid.

FIG. 8C is an exploded view diagram of one embodiment of a multifunction lid 104. In one embodiment, the second cover 612 is attached to the body 602 by one or more pivot pins 808, which are configured to engage mating pivot receivers 880 in the body 602. For example, the pivot receivers 880 may include one or more holes in a surface of the lid 104. The second cover 612 may be configured to cover the spout opening 830 in the lid 104 in order to inhibit liquid in vessel 202 from escaping or otherwise spilling. In another embodiment, second cover 612 can be further equipped with plug 860, which is positioned on the underside of second cover 612 so that it substantially fills second opening 830 when second cover 612 is in its closed/locked position. In this embodiment, plug 860 and second opening 830 are substantially the same shape, albeit plug 860 being slightly smaller so that it can snuggly nest inside second opening 830 in order to provide a substantially liquid-tight barrier.

FIG. 8C also illustrates an embodiment of first cover 614. As shown, first cover 614, with securing members 850 disposed underneath, can be fitted with cradle 870 before being installed onto lid 104 as described above. As shown, and as further described and illustrated above, first cover 614 is mounted and installed so that it is able to slide back and forth to increase or decrease the amount that first opening 810 is exposed (or open) to the atmosphere. Also, in an embodiment, as shown, first cover 614 is disposed on lid 104 so that it at least partially nests within second cover 612. This nesting relationship saves space on lid 104 and allows all its functionality to better fit within the confines of lid 104, even when lid 104 is used in connection with small vessels.

FIGS. 9A-9C illustrate operation of a second cover 612 of an embodiment of a multifunction lid 104. In FIG. 9A, the second cover 612 is in a closed position, thereby sealing opening 830. FIG. 9B illustrates operation of the second cover 612 over a pivot point, as described in more detail above with respect to FIG. 8. FIG. 9B also illustrates plug 860, which is attached to (or formed on) the underside of the second cover 612 in order to seal/close the second opening 830 when the second cover 612 is closed, so as to prevent liquid from spilling from the vessel 102. FIG. 9C illustrates an embodiment of the second cover 612 in an open position, where the second cover 612 is engaged with the tab 610 to maintain the second cover 612 in the open position. For example, in an embodiment, a groove or slot 410 (see FIG. 4) on a surface of the second cover 612 may be configured to receive an edge portion of the tab 610, thereby maintaining the second cover 612 in the open position.

In FIGS. 10A-C, operation of the first cover 614 is shown. In FIG. 10A, the first cover 614 is in the closed position such that first opening 810 is not open to the atmosphere. In FIG. 10B, the first cover 614 is in an open position such that first opening 810 is exposed to the atmosphere. In FIG. 10C, the first cover 614 is in a more open position such that first opening 810 is exposed to more of the atmosphere. As such, first cover 614 is able to slide back and forth between a fully open and a fully closed position, where first opening 614 is fully exposed to the atmosphere or not exposed to the atmosphere, respectively. As explained above, the more open (or exposed) first opening 810 is to the atmosphere, the more readily or easily liquid in vessel 102 will exit the vessel through second opening 830 (when second cover 612 is open). Controlling the exit rate of liquid from the second opening 830 (by controlling the size of the first opening that is open to the atmosphere) can be useful in a variety of situations. For example, if the user is drinking hot liquids from vessel 102, he or she likely prefers that the liquid exit more slowly in order to avoid being burned by the hot liquid. In this case, the user will position the first cover 614 so that the first opening 810 is relatively small. On the other hand, if the user is drinking cold liquids from vessel 102, he or she likely prefers that the liquid exit more rapidly. In this case, the user will position the first cover 614 so that the first opening 810 is relatively large.

As further illustrated by the embodiments of FIGS. 9-10, first cover 614 and second cover 612 may operate independently of one another. In other words, exposing or inhibiting the first opening 810 to the atmosphere using first cover 614 can be accomplished irrespective of the position or operation of the second cover 612. Likewise, opening or closing the second opening 830 to the atmosphere using the second cover 612 can be accomplished irrespective of the position or operation of the first cover 614.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. A container lid, comprising:

a circumferential edge sized to engage and disengage at least a circumferential edge of a container for containing a liquid;

an air opening in the lid through which air can pass;

a drinking opening in the lid through which liquids can pass;

a first cover for variably covering the air opening in more than two positions such that the size of the air opening has more than two sizes depending on the position of the first cover relative to the air opening; and a second cover for covering the drinking opening in a first position and for allowing access to the drinking opening in a second position, wherein the first cover variably covers the air opening by moving at least between a first position and a second position, whereby said movement of the first cover between its first and second position does not affect the position of the second cover.

2. The container lid of claim 1, wherein the lid further includes a body with a raised edge configured to prevent spillage of liquid.

3. The container lid of claim 2, wherein the lid includes a tab for assisting in removing said lid from a container and also for holding the second cover in its second position.

4. The container lid of claim 3, wherein an outer surface of the raised edge is contoured to engage a lip of a user when liquid is dispensed from the drinking opening.

5. The container lid of claim 4, wherein the lid includes a pivot so that the second cover moves about a hinged axis between its first and second position.

6. The container lid of claim 5, wherein the second cover includes a plug configured to seal the drinking opening when the second cover is in its first position.

7. The container lid of claim 6, wherein the second cover includes a locking mechanism configured to secure the second cover in its first position.

8. The container lid of claim 7, wherein the locking mechanism includes a locking tab that secures the second cover in its first position.

9. The container lid of claim 8, wherein the first cover includes a securing member that secures the first cover to the lid and allows the first cover to move between its positions.

10. The container lid of claim 9, wherein the first cover includes a cradle through which said securing member passes.

11. The container lid of claim 10, wherein the first cover is at least partially nested in the second cover on the surface of the lid.

12. The container lid of claim 11, wherein at least part of said first cover and at least part of said second cover are positioned within a recess on the surface of the lid.

13. The container lid of claim 12, wherein the first cover is at least partially disposed on the lid between a first and second pivot.

14. The container lid of claim 13 further comprising a container for containing a liquid and for engaging with the lid.

15. The container lid of claim 14, wherein a liquid dispenses more rapidly from the drinking opening when the first cover is in a first position than when in a second position.

16. The container lid of claim 15 further comprising a sealing member coupled to the lid, the sealing member configured to form a seal between the lid and the container.

* * * * *